United States Patent [19]

Takayama

[11] 4,363,303

[45] Dec. 14, 1982

[54] THROTTLE VALVE OPENING CONTROL DEVICE

[75] Inventor: Teruo Takayama, Katsuta, Japan

[73] Assignee: Hitachi, Ltd., Tokyo, Japan

[21] Appl. No.: 294,056

[22] Filed: Aug. 18, 1981

[30] Foreign Application Priority Data

Sep. 3, 1980 [JP] Japan ..... 55-121084
Sep. 10, 1980 [JP] Japan ..... 55-124602

[51] Int. Cl.[3] ..... F02D 11/10
[52] U.S. Cl. ..... 123/339; 123/376
[58] Field of Search ..... 123/339, 361, 376, DIG. 11

[56] References Cited

U.S. PATENT DOCUMENTS 4,212,272 7/1980 Hawk ..... 123/339

FOREIGN PATENT DOCUMENTS 55-69745 11/1979 Japan .

*Primary Examiner*—William A. Cuchlinski, Jr.
*Attorney, Agent, or Firm*—Antonelli, Terry & Wands

[57] ABSTRACT

A throttle valve opening control device for an internal combustion engine operative to control the opening of a throttle valve by supplying a signal based on the results of feeding of operation parameters of the internal combustion engine into a computer to a throttle valve actuator comprising an initial stage speed reducing gear secured to a DC motor, and a final stage speed reducing gear for driving an output shaft for opening and closing the throttle valve. The initial stage speed reducing gear and the final stage speed reducing gear are located on the same axial line, and a side of the initial stage speed reducing gear opposite the side thereof at which the DC motor is secured is in bearing relation to the final stage speed reducing gear.

8 Claims, 4 Drawing Figures

THROTTLE VALVE OPENING CONTROL DEVICE

BACKGROUND OF THE INVENTION (1) Field of the Invention

This invention relates to a throttle valve opening control device for automatically increasing or reducing the opening of a throttle valve mounted in a suction supply device for supplying air or a mixture of air and field to an internal combustion engine.

(2) Description of the Prior Art

Generally, in a throttle valve opening control device suitable for use as a constant speed travelling device or an idle speed control device for automotive vehicles, a throttle valve actuator comprising a DC motor and speed reducing gears is used as means for increasing or decreasing the opening of a throttle valve. In this actuator, when an electric pulse is passed to the DC motor to increase or decrease the throttle valve opening, the DC motor is rotated in accordance with the polarity and the duration of the pulse, its rotation being converted through the speed reducing gears to the reciprocatory movement of an output shaft which drives a throttle valve shaft having the throttle valve secured thereto, to thereby control the opening of the throttle valve.

What is most important to this type of throttle valve opening control device and therefore most pined after is to obtain a compact size in throttle valve actuator and to improve its performance. This is considered to be readily understood in view of the fact that this type of throttle valve actuator is mounted in the engine room of an automotive vehicle.

SUMMARY OF THE INVENTION

This invention has as its object the provision of a throttle valve opening control device of compact size and high reliability that is suitable for mounting in the engine room of an automotive vehicle.

The outstanding characteristic of the invention is that an initial stage speed reducing gear secured to an electric rotary machine and a final stage speed reducing gear for driving an output shaft for opening and closing a throttle valve are arranged on the same axial line, and a side of the initial stage speed reducing gear opposite the side thereof at which the electric rotary machine is secured is in bearing relation to the final stage speed reducing gear.

DESCRIPTION OF THE PREFERRED EMBODIMENTS

Figure 1:
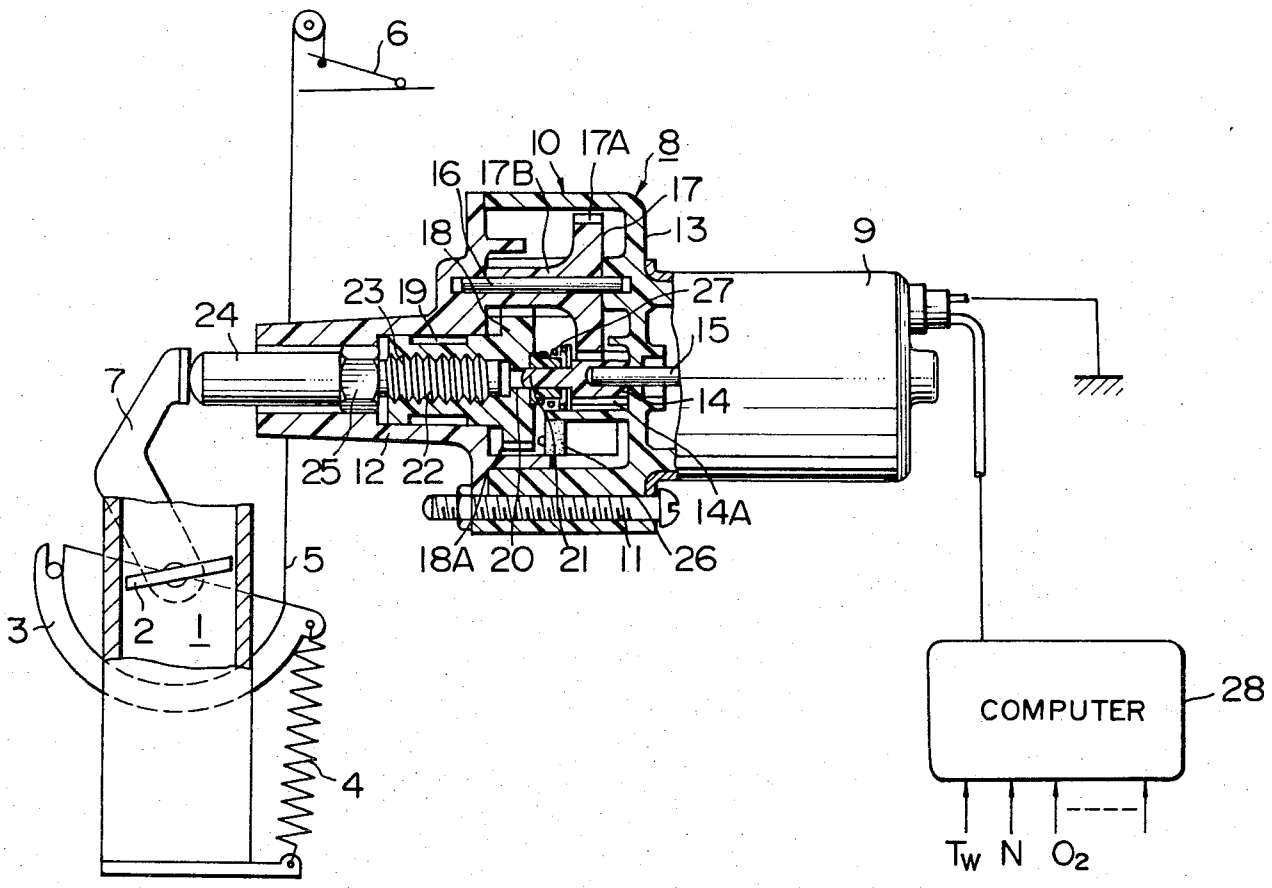
FIG. 1 is a schematic view, partly shown in section, of the throttle valve opening control device according to one embodiment of the invention.

Preferred embodiments of the invention will now be described by referring to the accompanying drawings. In FIG. 1, an intake passage 1 has a throttle valve 2 mounted therein. A throttle valve lever 3 linked to the throttle valve 2 is biased by a tension spring 4 in a direction in which the throttle valve 2 is closed. A cable 5 is connected to the throttle valve lever 3 to link the latter to an acceleration pedal 6.

The throttle valve 2 is opened by force transmitted through the cable 5 from the acceleration pedal 6 and is normally closed by the tension spring 4.

An engaging member 7 has one end thereof connected to the throttle valve lever 3 and the other end engageable with a throttle valve actuator 8.

The throttle valve actuator 8 comprises, as a drive source, a DC motor 9 which is rendered unitary with a speed reducing gear mechanism 10 by screw 11. The speed reducing gear mechanism 10 comprises cases 12 and 13 formed of a synthetic resinous material, and a speed reducing gear train contained in the cases 12, 13. The arrangement of the speed reducing gear train will be described. An initial stage speed reducing gear 14 formed of a synthetic resinous material is secured to a rotary shaft 15 of the DC motor 9 so that rotation of the DC motor 9 is transmitted to the rotary shaft 15. A shaft 16 mounted in offset relation from the center of rotation of the initial stage speed reducing gear 14 supports for rotation a second stage speed reducing gear 17 which is also formed of a synthetic resinous material and has gear teeth 17A arranged circumferentially of the gear 17. The gear teeth 17A are in meshing engagement with gear teeth 14A arranged circumferentially of the initial stage speed reducing gear 14, so that rotation of the initial stage speed reducing gear 14 is transmitted to the second stage speed reducing gear 17 after having its speed reduced. Rotation of the second stage speed reducing gear 17 is transmitted, through another gear teeth 17B arranged circumferentially of the gear 17, to gear teeth 18A arranged circumferentially of the final stage speed reducing gear 18 which is also formed of a synthetic resinous material. As shown in FIG. 1, the final stage speed reducing gear 18 is arranged in a recess 19 of the case 12 for rotational and sliding movements. The final stage speed reducing gear 18 has a center of rotation which is located on the same axis as the center of rotation of the initial stage speed reducing gear 14.

The final stage speed reducing gear 18 is formed at the center of its rotation with a bearing boss 20 which journals a shaft portion 21 of the initial stage speed reducing gear 14. By this structural arrangement, the final stage speed reducing gear 18 and the initial stage speed reducing gear 14 are located on the same axial line.

The final stage speed reducing gear 18 is formed in the vicinity of the center of its rotation in the interior with a female threaded portion 22 with which an output shaft 24 formed of metal having a male threaded portion 23 is in threadable engagement. The output shaft 24 is formed with a hexagonal portion 25 to prevent same from rotating relative to the case 12. Thus, upon rotation of the final stage speed reducing gear 18, the output shaft 24 moves in reciprocatory movement due to the threadable engagement of the female threaded portion 22 with the male threaded portion 23. Reciprocatory movement of the output shaft 24 causes the engaging member 7 of the throttle valve lever 3 to be angularly moved, to thereby vary the opening of the throttle valve 2.

As can be appreciated in the aforesaid description, the outstanding characteristic of the speed reducing gear mechanism 10 is that the center axis of the output shaft 24 and the centers of rotation of the final stage speed reducing gear 18 and the initial stage speed reducing gear 14 are located on the same axial line, while the initial stage speed reducing gear 14 is supported by the final stage speed reducing gear 18 itself.

The speed reducing gear mechanism 10 has built in the interior a contact switch 26 having the function of sensing the displacement of the final stage speed reducing gear 18. More specifically, as the throttle valve 2 is closed by the biasing force of the tension spring 4, the movement of the throttle valve 2 is transmitted through the engaging member 7 and the output shaft 24 to the final stage speed reducing gear 18 which moves in sliding movement in the recess 19 against the biasing force of a compression spring 27 rightwardly in FIG. 1, to thereby open or close the contact switch 26. The contact switch 26 has, in view of the arrangement whereby the output shaft 24 is mounted in a manner to be engaged by the engaging member 7 of the throttle valve lever 3, the function of providing information that the driver is not operating the accelerating pedal 6 when the load applied by the tension spring 4 acts on the output shaft 24 and that the driver is operating the acceleration pedal 6 when no load acts on the output shaft 24. Stated differently, the function of the contact switch 26 is to indicate idling of the engine. The contact switch 26 has particular utility with an idle speed control device and is shown in detail in FIG. 4 and to be subsequently to be described.

Control pulses are fed from a computer 28 to the DC motor 9, and the polarity and the duration of the control pulses may vary depending on the values of the operation parameters including the cooling water temperature Tw, engine speed N and exhaust gas concentration $O_2$.

The operation of an idle speed control device using the throttle valve actuator of the aforesaid construction will now be described. The idle speed control device is a device for controlling the idle speed from one minute to the next by comparing the actual engine speed with a target speed which may vary depending on the temperature of the engine.

Upon the cooling water temperature Tw being fed into the computer 28, a target speed is calculated which corresponds to the cooling water temperature Tw. Then the actual engine speed N is also fed into the computer 28, and the actual engine speed N is compared with the target speed at a comparator in the computer 28. A control pulse is transmitted to the DC motor 9 based on the result of the comparison. In the event that the actual speed is higher than the target speed, for example, a normal pulse is transmitted to the DC motor 9 to cause the initial stage speed reducing gear 14, second stage speed reducing gear 17 and final stage speed reducing gear 18 to rotate while reducing their speeds. As a result, the output shaft 24 gradually shifts rightwardly in FIG. 1 to cause the engaging member 7 to move clockwise in pivotal movement, so that the opening of the throttle valve 2 is decreased to reduce the actual speed to a level in which it agrees with the target speed. Conversely, when the actual speed is lower than a target speed, a reverse pulse is transmitted to the DC motor 9 to shift the output shaft 24 leftwardly in FIG. 1 through the gears 14, 17 and 18, to cause the engaging member 7 to move counterclockwise in pivotal movement to increase the opening of the throttle valve 2 and raise the actual speed to a level in which it agrees with the target speed.

In the throttle valve actuator performing the aforesaid operation, it is essential that the size can be reduced as much as possible while improving performance, to enable the actuator to be mounted in an engine room. In the present invention, the initial stage speed reducing gear 14 and final stage speed reducing gear 18 are located on the same axial line. This structural arrangement enables the projected area in the right-angle direction to be minimized with respect to the axial line, thereby permitting a compact size to be obtained. Also, the shaft portion 21 of the initial stage speed reducing gear 14 is journaled on the bearing boss 20 of the final stage speed reducing gear 18 as the initial stage speed reducing gear 14 and final stage speed reducing gear 18 are arranged on the same axial line. By virtue of this structural arrangement, mis-contact of the initial stage speed reducing gear 14, second stage speed reducing gear 17 and final stage speed reducing gear 18 with each other that might otherwise be caused by engine vibration can be avoided, thereby improving performance.

From the foregoing description, it will be appreciated that the throttle valve opening control device according to the invention meets the requirement of reducing size without performance that should be satisfied for mounting such actuator in an engine room of an automotive vehicle.

Figure 2:
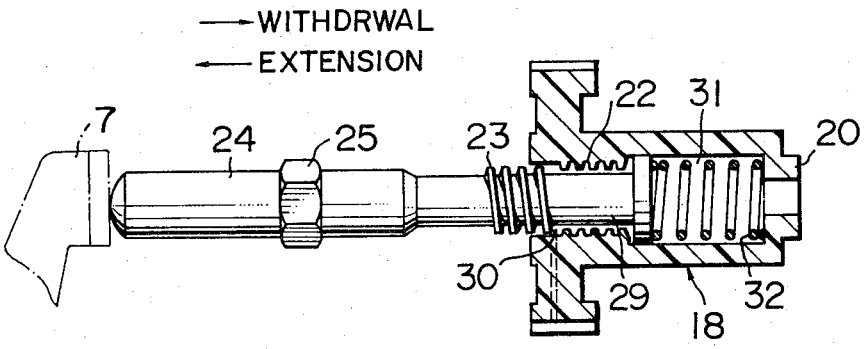
FIG. 2 is a sectional view showing the essential portions of the throttle valve opening control device in accordance with another embodiment.

FIG. 2 shows another embodiment which represents an improvement over the embodiment shown in FIG. 1.

In FIG. 2, the output shaft 24 and the final stage speed reducing gear 18 are shown on an enlarged scale. The output shaft 24 is formed, in addition to the male threaded portion 23, with a planar circumferential portion which is a cylindrical portion 29 disposed on the initial stage speed reducing gear 14 side. The cylindrical portion 14 has the safety function of avoiding runaway of the vehicle. More specifically, if the displacement of the output shaft 24 exceeds a predetermined limit when it shifts in a direction in which the throttle valve 2 is opened, then the male threaded portion 23 of the output shaft is released from threadable engagement with the female threaded portion 22 of the final stage speed reducing gear 18, thereby regulating the movement of the output shaft 24. When the output shaft 24 is released from engagement with the final stage reduced speed gear 18 as aforesaid, the final stage speed reducing gear 18 merely rotates idle.

As the final stage speed reducing gear 18 is rotating in idle manner around the cylindrical portion 29 of the output shaft 24, the end surface of the male threaded portion 23 formed of metal in the output shaft 24 might impinge against the female threaded portion 22 formed of a synthetic resinous material and the female threaded portion 22 might be scraped. When this phenomenon happens, grits might enter the female threaded portion, thereby giving rise to the problems of the loss of power and the development of a lock. To obviate these problems, a protective pin 30 formed of metal is located at the vicinity of a starting part of the female threaded portion 22 formed in the final stage speed reducing gear 18 or in a part of the final stage speed reducing gear 18 interposed between the female threaded portion 22 of the final stage speed reducing gear 18 and the male threaded portion 23 of the output shaft 24 when the final stage speed reducing gear 18 is idling. The protective pin 30 projects toward the outer periphery of the shaft 24 a distance which is equal to or slightly smaller than the height of the female threaded portion 22. Thus, even if the final stage speed reducing gear 18 rotates in idle manner, the protective pin 30 is into contact with the male threaded portion 23 to prevent the male threaded portion 23 from being in direct contact with the female threaded portion 22, thereby avoiding scraping of the female threaded portion 22.

The aforesaid description deals with the problems that might be raised when the projecting of the output shaft 24 is maximized and the means for avoiding such problems. The problems that might be raised when the withdrawing of the output shaft 24 is maximized and the means for solving such problems will now be described.

Assume that the withdrawing of the output shaft 24 is maximized. Then the male threaded portion 23 formed on the output shaft 24 will be released from engagement with the female threaded portion 22 formed in the final stage speed reducing gear 18, so that the output shaft 24 will difficulty be brought into engagement with the final stage speed reducing gear 18 again.

To obviate this problem, a guide chamber 31 for the output shaft 24 is formed in the final stage speed reducing gear 18 and a compression spring 32 is mounted in the guide chamber 31. By this structural arrangement, the compression spring 32 brings the male threaded portion 23 of the output shaft 24 into contact with the female threaded portion 22 of the final stage speed reducing gear 18 at all times even if the withdrawing of the output shaft 24 is maximized, thereby enabling the output shaft 24 to be positively brought into engagement with the final speed reducing gear 18 again.

A modification of the embodiment shown in FIG. 2 will now be described by referring to FIG. 3. Parts performing functions similar to those performed by the parts shown in FIG. 2 will be indicated by numerals having a subscript A.

Figure 3:
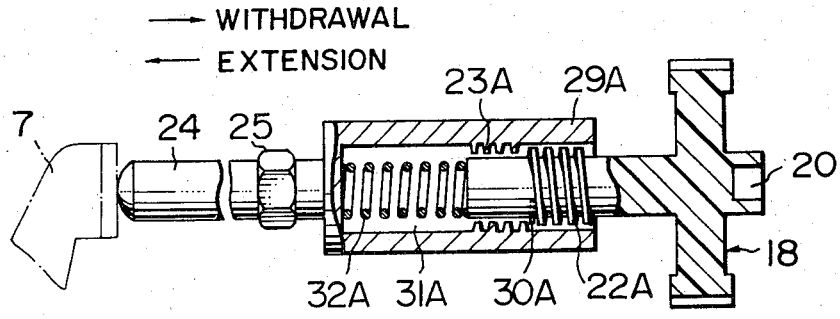
FIG. 3 is a sectional view of the essential portions of a modification of the throttle valve opening control device shown in FIG. 2.

In FIG. 3, the final stage speed reducing gear 18 is formed on its projection a threaded portion 22A which is formed on the outer circumferential surface on the final stage speed reducing gear 18, as can be clearly seen by comparing FIG. 3 having the threaded portion 22A with FIG. 2. A threaded portion 23A formed on the inner circumferential surface of the output shaft 24 is in threadable engagement with the threaded portion 22A, to thereby convert rotation of the final stage speed reducing gear 18 to reciprocatory displacement. A planar inner circumferential portion 29A formed on the inner circumferential surface of the output shaft 24 between the threaded portion 23A of the output shaft 24 and the axially opposed portion of the final stage speed reducing gear 18 performs the same function as the inner circumferential portion 29 shown in FIG. 2. A protective pin 30A formed of metal is attached to the final stage speed reducing gear 18 between the threaded portion 22A of the final stage speed reducing gear 18 and the threaded portion 23A of the output shaft 24 under the condition of the final stage speed reducing gear 18 rotating in idle manner. The protective pin 30A has the same function as the protective pin 30 shown in FIG. 2. A compression spring 32A is arranged between the output shaft 24 and the final stage speed reducing gear 18 and performs the same function as the compression spring 32 shown in FIG. 2.

Figure 4:
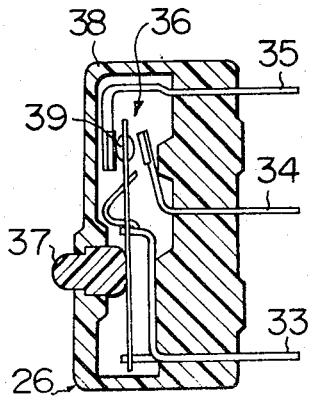
FIG. 4 is a sectional view of the contact switch.

The construction of the contact switch 26 will be described by referring to FIG. 4. The contact switch 26 comprises terminals 33, 34 and 35, a contact mechanism 36 and a pushbutton 37 which are encased in a switch case 38 formed of a synthetic resinous material. When no load is applied to the pushbutton 37 of the aforesaid contact switch 26, a contact 39 connects the terminals 33 and 35 to each other as shown in FIG. 4; when a load is applied, the contact 39 moves to bring the terminals 33 and 34 into contact with each other. The movement of the contact 39 is determined by whether or not the pushbutton 37 presses the contact mechanism 36. Thus, it can be judged whether the vehicle is idling or not. The use of the contact switch 26 offers the advantage that the final stage speed reducing gear 18 for opening and closing the contact switch 26 has only to move a small distance.

More specifically, when the movement of contact mechanism 36 for opening and closing the contact switch 26 is constant in amount at all times, the final stage speed reducing gear 18 has only to move the same distance as the contact mechanism 36 according to this embodiment.

Thus, when the driver releases the acceleration pedal 6, the switch responds quickly in being moved from the open position to the closed position, so that the phenomenon that the switch is not moved to the closed position when the driver unconsciously rests his foot on the acceleration pedal 6 can be avoided.

The construction in which the contact mechanism 36 is covered with the switch case 38 offers the advantage that even if the grease applied to the gear portions or other lubricant is scattered, it would not be deposited on the contact 39 thereby avoiding the occurrence of malfunction of the switch.

From the foregoing description, it will be appreciated that the throttle valve opening control device according to the invention has the feature that the initial stage speed reducing gear and the final stage speed reducing gear are arranged on the same axial line while the initial stage speed reducing gear is journaled by the final stage speed reducing gear itself. Thus, a compact size can be obtained in throttle valve opening control device and its reliability can be improved, so that the throttle valve opening control device according to the invention is suitable for use in the engine room of an automotive vehicle.

What we claim is:

1. A device for controlling an opening degree of a throttle valve of an internal combustion engine, comprising:

a computer for generating electric signals in response to operating parameters of the engine;

an electric rotary machine driven in response to the electric signals from said computer;

an initial stage speed reducing gear rotated around its rotational axis by said electric rotary machine and having first gear teeth arranged circumferentially of said initial stage speed reducing gear;

an intermediate speed reducing gear having a rotational axis thereof offset from the rotational axis of said initial stage speed reducing gear, said intermediate speed reducing gear having arranged circumferentially thereof second gear teeth in mesh with said first gear teeth of said initial stage speed reducing gear, said intermediate speed reducing gear further having arranged circumferentially thereof third gear teeth;

a final stage speed reducing gear having a rotational axis thereof in coaxial relation to the rotational axis of said initial stage speed reducing gear, said final stage speed reducing gear having arranged circumferentially thereof fourth gear teeth in mesh with said third gear teeth of said intermediate speed reducing gear;

a shaft extending in coaxial relation to the rotational axes of said initial and final stage speed reducing gears, said shaft having one end thereof secured to an end surface of one of said initial and final stage speed reducing gears, and a bearing section formed in an end surface of the other speed reducing gear opposite to the end surface of said one speed reducing gear for rotatably supporting the other end of said shaft;

a threaded portion formed in an end of said the other speed reducing gear opposite to the end surface thereof having formed therein said bearing section and extending in concentric relation to the rotational axis of said the other speed reducing gear;

an output shaft having thereon a threaded portion threadedly engageable with said threaded portion in said the other speed reducing gear for converting the rotational movement of said the other speed reducing gear to the reciprocal movement of said output shaft;

a case attached in unitary relation to said electric rotary machine for surrounding at least said initial, intermediate and final stage speed reducing gears; and said throttle valve being operative in response to the reciprocal movement of said output shaft for adjusting flow rate of fluid introduced into the engine.

2. A control device as claimed in claim 1, wherein said final stage speed reducing gear is supported by said case for movement axially of said final stage speed reducing gear, and wherein said control device further includes an electric contact switch disposed within said case and opened and closed when said final stage speed reducing gear axially moves a predetermined amount of distance.

3. A control device as claimed in claim 1, wherein said output shaft is formed with a planar circumferential portion operative to bring the output shaft out of threadable engagement with the final stage speed reducing gear when the final stage speed reducing gear has caused the output shaft to move over a predetermined amount to open the throttle valve to a predetermined opening level.

4. A control device as claimed in claim 3, wherein the final stage speed reducing gear is formed of a synthetic resinous material and the output shaft is formed of metal.

5. A control device as claimed in claim 4, wherein said final stage speed reducing gear has a metallic pin attached to a portion of the final stage speed reducing gear interposed between said threaded portion of the final stage speed reducing gear and said threaded portion of the output shaft when the final stage speed reducing gear is idling after causing the output shaft to move over the predetermined distance, said metallic pin having a length equal to or smaller than the height of the thread of said threaded portion formed in the final stage speed reducing gear.

6. A control device as claimed in claim 1, wherein resilient means is mounted between said initial stage speed reducing gear and said output shaft for urging the former to move away from the latter by its biasing force.

7. A control device as claimed in claim 6, wherein said resilient means comprises a compression spring.

8. A control device as claimed in claim 2, wherein said electric contact switch comprises a pushbutton engageable by the final stage speed reducing gear, a contact mechanism actuated by said pushbutton, terminals opened and closed by a contact of the contact mechanism and a case formed of a synthetic resinous material housing the elements of the contact switch.

* * * * *